US008206140B2

(12) United States Patent
Ooi et al.

(10) Patent No.: US 8,206,140 B2
(45) Date of Patent: Jun. 26, 2012

(54) REVOLVING VANE COMPRESSOR

(75) Inventors: Kim Tiow Ooi, Singapore (SG); Yong Liang Teh, Singapore (SG)

(73) Assignee: Nanyang Technological University, Singapore (SG)

( * ) Notice: Subject to any disclaimer, the term of this patent is extended or adjusted under 35 U.S.C. 154(b) by 706 days.

(21) Appl. No.: 12/305,879

(22) PCT Filed: Jun. 28, 2007

(86) PCT No.: PCT/SG2007/000187

§ 371 (c)(1),
(2), (4) Date: Dec. 19, 2008

(87) PCT Pub. No.: WO2008/004983

PCT Pub. Date: Jan. 10, 2008

(65) Prior Publication Data

US 2009/0180911 A1 Jul. 16, 2009

Related U.S. Application Data

(60) Provisional application No. 60/819,009, filed on Jul. 7, 2006.

(51) Int. Cl.
*F03C 2/00* (2006.01)
*F03C 4/00* (2006.01)

(52) U.S. Cl. ..... 418/173; 418/138; 418/259

(58) Field of Classification Search ..... 418/259, 418/138, 173

See application file for complete search history.

(56) References Cited

U.S. PATENT DOCUMENTS

| | | | | |
|---|---|---|---|---|
| 1,352,107 | A | 9/1920 | Wagenhorst | |
| 1,851,193 | A * | 3/1932 | Laraque | 418/173 |
| 1,941,651 | A | 1/1934 | Behlmer | |
| 2,002,827 | A | 5/1935 | Morch | |
| 2,705,591 | A * | 4/1955 | Anderson | 418/173 |
| 2,714,372 | A * | 8/1955 | Williams | 418/173 |
| 2,891,482 | A | 6/1959 | Menon | |
| 3,298,331 | A * | 1/1967 | Butler | 418/173 |
| 4,568,257 | A | 2/1986 | Moore | |
| 4,673,343 | A | 6/1987 | Moore | |
| 5,396,930 | A * | 3/1995 | Ebbing et al. | 137/856 |

(Continued)

FOREIGN PATENT DOCUMENTS

GB 363471 A * 11/1930

OTHER PUBLICATIONS

Search Report and Written Opinion for Application No. SG 200809101-9 dated Nov. 19, 2009.

(Continued)

*Primary Examiner* — Theresa Trieu
(74) *Attorney, Agent, or Firm* — Carlson Gaskey & Olds P.C.

(57) ABSTRACT

An exemplary revolving vane compressor includes a cylinder having a discharge port in and through the cylinder. A rotor housed within the cylinder is eccentrically mounted relative to the cylinder. A vane is mounted in a slot in the rotor. The vane is for sliding movement relative to the rotor. The vane is securely connected to the cylinder to force the cylinder to rotate with the rotor. A pressure shell surrounds the cylinder and the rotor. Each discharge port is for discharging fluid into an enclosed volume of the pressure shell. The cylinder is held within the enclosed volume.

22 Claims, 4 Drawing Sheets

U.S. PATENT DOCUMENTS 5,564,916 A 10/1996 Yamamoto et al.
6,666,671 B1 12/2003 Olver et al.

OTHER PUBLICATIONS

"Experimental Investigations on Rotary Vane Compressors," H. Kruse, Professor of Refrigeration Engineering, University Hannover, Germany, pp. 382-388.

International Search report and Written Opinion in PCT/SG2007/000187, dated Aug. 2, 2007.

International Preliminary Report on Patentability in PCT/SG2007/000187, dated Jun. 16, 2008.

"Dynamic Model of a Valve Reed with Centrifugal Loading," Y.L. Teh, K.T. Ooi, School of Mechanical and Aerospace Engineering, Nanyang Technological University, Innovative Equipment and Systems for Comfort and Food Preservation, New Zealand, 2006.

"Geometrical Optimisation of the Revolving Vane Compressor," K.T. Ooi, Y.L. Teh, International Compressor Engineering Conference at Purdue, Jul. 17-20, 2006.

"Design and Friction Analysis of the Revolving Vane Compressor," Y.L. Teh, K.T. Ooi, International Compressor Engineering Conference at Purdue, Jul. 17-20, 2006.

"Dynamic Behavior of Twin-Piece Vane Machine," Ma Guoyuan, Yan Qisen, Yu Yongzhangm, Journal of Mechanical Design, vol. 124, Mar. 2002, pp. 74-78.

"Experimental Investigations on Rotary Vane Compressors," H. Kruse, Professor of Refrigeration Engineering, University Hannover, Germany, pp. 382-388, International Compressor Engineering Conferenece, Jan. 1980, Paper 318.

* cited by examiner

REVOLVING VANE COMPRESSOR

This Application is the National Phase under 35 U.S.C. §371 of PCT International Application No. PCT/SG2007/000187, which has an international filing date of 28 Jun. 2007 and has designated the United States of America.

REFERENCE TO RELATED APPLICATION

Reference is made to our provisional patent application filed in the United States on 7 Jul. 2006 under No. 60/819,009 for an invention entitled "Revolving Vane Compressor", the contents of which are hereby incorporated by reference as if disclosed herein in their entirety, and the priority of which is claimed.

TECHNICAL FIELD

This invention relates to a revolving vane compressor and refers particularly, though not exclusively, to a revolving vane compressor with a rotor eccentrically mounted relative to a cylinder.

BACKGROUND

One of the crucial factors affecting the performance of a compressor is its mechanical efficiency. For example, the reciprocating piston-cylinder compressor exhibits good mechanical efficiency, but its reciprocating action results in significant vibration and noise problems. To negate such problems, rotary type compressors have been developed and have since gained much popularity due to their compact nature and good vibration Characteristics. However, as their parts in sliding contact generally possess high relative velocities, frictional losses are predominant and have thus limited the efficiency and reliability of the machines. For instance, in Rotary Sliding Vane compressors, the rotor and vane tips rub against the cylinder interior at high velocities, resulting in enormous frictional losses. Similarly, in Rolling-Piston compressors, the rolling piston rubbing against the eccentric and the cylinder interior also result in significant losses. It is therefore believed that if the relative velocities of the rubbing components in rotary compressors can be effectively reduced, their overall performance and reliability can be improved substantially.

SUMMARY

According to an exemplary aspect there is provided a revolving vane compressor comprising a cylinder, a rotor housed within the cylinder and being eccentrically mounted relative to the cylinder, and a vane mounted in a slot in the rotor for sliding movement relative to the rotor, the vane being securely connected to the cylinder to force the cylinder to rotate with the rotor.

The rotor may be configured to be driven by a drive shaft. The rotor may be configured to drive the cylinder by operative connection of the vane to the cylinder. The rotor may have a rotor longitudinal axis and the cylinder may have a cylinder longitudinal axis parallel to and spaced from the rotor longitudinal axis. The rotor may further comprise a rotor shaft co-axial with rotor longitudinal axis. There may be a suction inlet in the rotor shaft operatively connected to at least one suction port in a surface of the rotor. The operative connection may comprise a first portion of a suction inlet extending axially of the rotor shaft, and a second portion extending radially of the rotor.

The cylinder may comprise a side wall and a pair of opposed end plates all of which are configured to rotate with the rotor. The cylinder may further comprise at least one discharge port in and through the cylinder. Each discharge port may comprise a discharge valve. Each discharge valve may comprise a discharge valve reed over each discharge port, and a valve stop. Each discharge port may be in and through the side wall of the cylinder. The revolving vane compressor may further comprise a high-pressure shell. Each discharge port may be for discharging fluid into an enclosed volume of the high-pressure shell.

The vane may comprise an enlarged head that engages the cylinder in the manner of a hinge-type joint. The slot may extend relative to the rotor in a manner selected from: radially of the rotor, at an offset angle relative to the rotor, and circularly curved relative to the rotor.

A working chamber may be formed between the cylinder and the rotor. The working chamber may comprise a suction chamber and a compression chamber. The vane may separate the working chamber into the suction chamber and the compression chamber. A line contact may be formed between the rotor and an internal surface of the cylinder.

BRIEF DESCRIPTION OF THE DRAWINGS

In order that the invention may be fully understood and readily put into practical effect there shall now be described by way of non-limitative example only exemplary embodiments, the description being with reference to the accompanying illustrative drawings.

In the drawings.

DETAILED DESCRIPTION OF THE PREFERRED EMBODIMENTS

Figure 1:
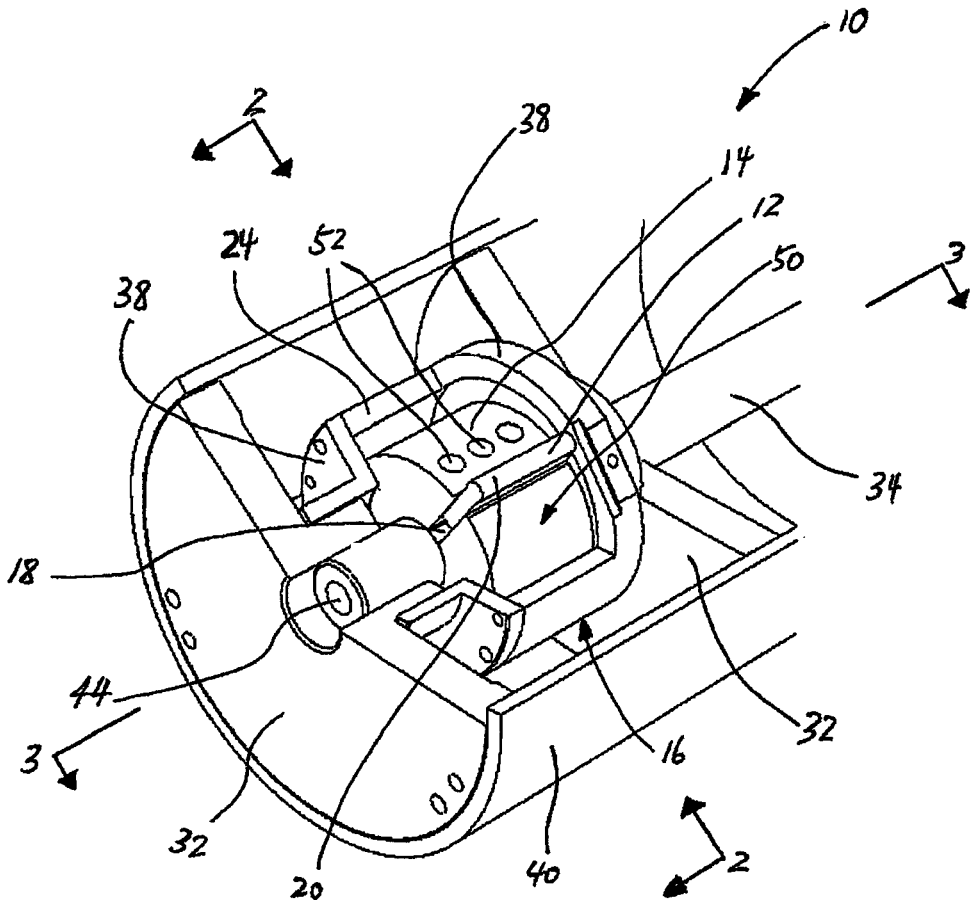
FIG. 1 is a front perspective in partial cutaway of an exemplary embodiment.
Figure 2:
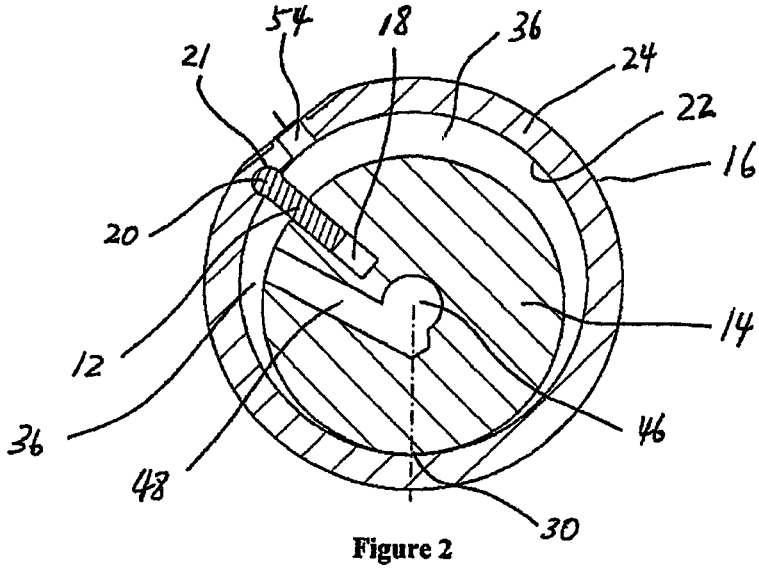
FIG. 2 is a vertical partial cross-sectional view along the lines and in the direction of arrows 2-2 on FIG. 1.

As shown in FIGS. 1 to 6, there is a revolving vane compressor 10 that has similar components to a known rotary sliding vane compressor but with only one vane 12. The main components are: a rotor 14, the vane 12 and a cylinder 16.

The vane 12 is assembled with the rotor 14 such that it is a sliding fit within a radially-directed, blind slot 18 in the outer portion of the rotor 14. Both the vane 12 and the rotor 14 are housed in the cylinder 16. The enlarged and curved head 20 of the vane 12 is connected via a hinge-type joint 21 to an internal surface 22 of a side wall 24 of the cylinder 16, the side wall 24 being cylindrical and of a larger diameter than the rotor 14. This provides a secure attachment of the vane 12 to the cylinder 16.

Figure 3:
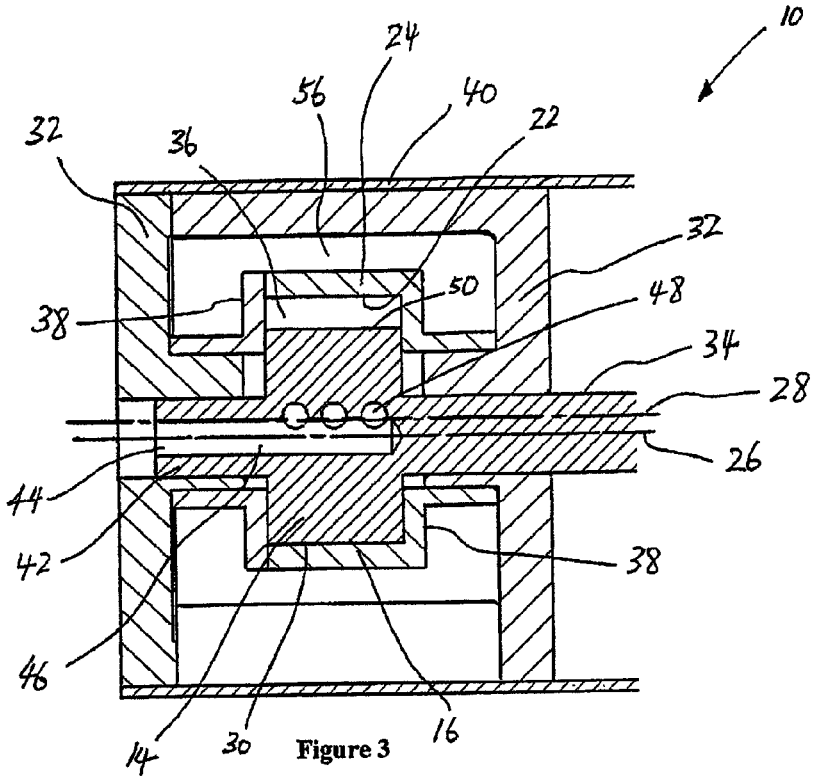
FIG. 3 is a vertical cross-sectional view along the lines and in the direction of arrows 3-3 on FIG. 1.

The rotor 14 is mounted for rotation about a first longitudinal axis 26 and the cylinder 16 is mounted for rotation about a second longitudinal axis 28 (FIG. 3). The two axes 26, 28 are parallel and spaced apart such that the rotor 14 and the cylinder 16 are assembled with an eccentricity. In consequence, during rotation of the rotor 14 and the cylinder 16, a line contact 30 always exists between the rotor 14 and the interior surface 22 of the side wall 24. Both the rotor 14 and the cylinder 16 are supported individually and concentrically by journal bearing pairs 32. Both the rotor 14 and the cylinder 16 are able to rotate about their respective longitudinal axes 26, 28 respectively, the two axes 26, 28 also being the axes of rotation.

A drive shaft 34 is operatively connected to or integrated with the rotor 14 and is preferably co-axial with the rotor 14. The drive shaft 34 is able to be coupled to a prime mover (not shown) to provide the rotational force to the rotor 14 and thus to the cylinder 16 via the vane 12.

During operation, the rotation of the rotor 14 causes the vane 12 to rotate which in turn forces the cylinder 16 to rotate due to the secure attachment provided by the hinge-type point 21. The motion causes the volumes 36 trapped within the vane 12, cylinder 16 and the rotor 14 to vary, resulting in suction, compression and discharge of the working fluid.

The cylinder 16 also has flanged end plates 38 that may be integral with the side wall 24, or may be separate components securely attached to side wall 24. As such, the end plates 38 also rotate as the entire cylinder 16, including side wall 24 and end plates 38, is made to rotate by the vane 12, and thus rotate with the rotor 14. By doing so friction between the vane 12 and the internal surface 22 of the side wall 24 is virtually eliminated. However, it does cause the addition of a cylinder journal bearing at journal bearing pair 32 to support the rotating cylinder 16 which results in additional frictional losses. Those losses are of a lower magnitude as it is relatively easy to provide lubrication to the journal bearing pairs 32. Also, frictional loss between the rotor 14 and the cylinder end plates 38 is reduced to a negligible level, as will be explained below.

The entire cylinder 16, with the end plates 38, is able to rotate. This reduces friction at the sliding contacts between the end faces 38 of the cylinder 16, and the rotor 14. This is because the relative, sliding velocity between the end plates 38 and the rotor 14 is significantly reduced.

Although known designs using fixed end plates simplify the positioning of the discharge and the suction ports, they result in significant frictional losses. They have a stationary housing against which the rotor rotates, thus inducing large frictional losses. This reduces the mechanical efficiency of the machine, and also reduces reliability due to greater wear-and-tear. The heat generated by the friction also reduces the overall compressor performance due to suction heating effects.

As all the primary components of the compressor 10 are in rotation, the suction and discharge ports are also in motion. The compressor 10 therefore may have a high-pressure shell 40 that surrounds the cylinder 16 and rotor 14. The high-pressure shell 40 is stationary, with the cylinder 16 and rotor 14 rotating within and relative to the shell 40.

The suction inlet 44 is along the rotor shaft 34 and co-axial with the axis of rotation 26 of the rotor 14 and is operatively connected to the suction pipe (not shown). The suction inlet 44 has a first portion 46 that extends axially of the shaft 42; and one or more second portions 48 that extend radially of the rotor 14 to the outer surface 50 of the rotor 14 to provide one or more suction ports 52. The number of second portions 48 and suction ports 52 may depend on the use of the compressor 10, and the axial extent of the rotor 14.

One or more discharge ports 54 are positioned in and through the side wall 24 of the cylinder 16. As such the discharged gas or fluid is contained within the hollow interior 56 of the shell 40 before exiting from the compressor 10 using a known exit apparatus. The discharge ports 54 each have a discharge valve assembly 58 positioned over the discharge ports 54. The discharge valve assembly 58 has a valve stop 60 securely mounted to the side wall 24 of cylinder 16 by a fastener 62; as well as a discharge valve reed 64 over the discharge port 54.

Figure 4:
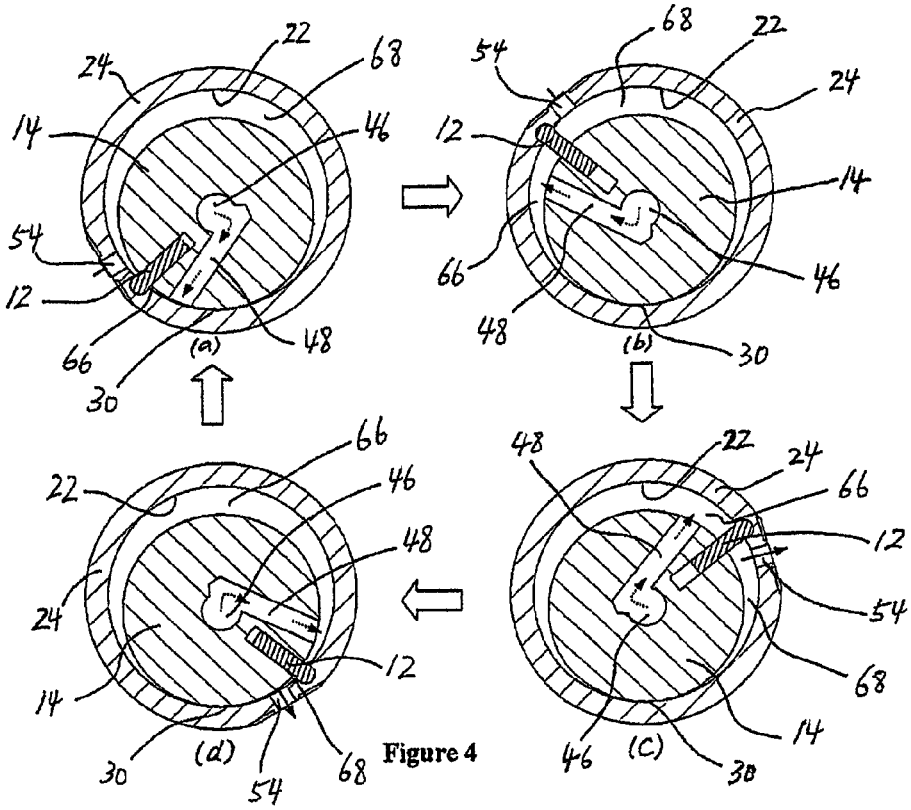
FIG. 4 is a series of illustrations corresponding to FIG. 2 showing the working cycle of the exemplary embodiment of FIGS. 1 to 3.
Figure 5:
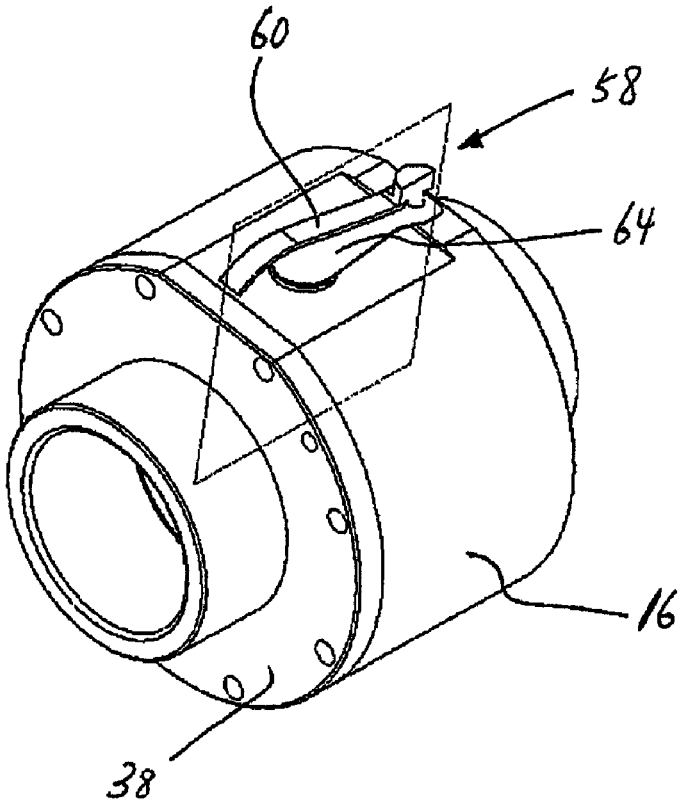
FIG. 5 is a front perspective in partial cutaway of the exemplary embodiment.
Figure 6:
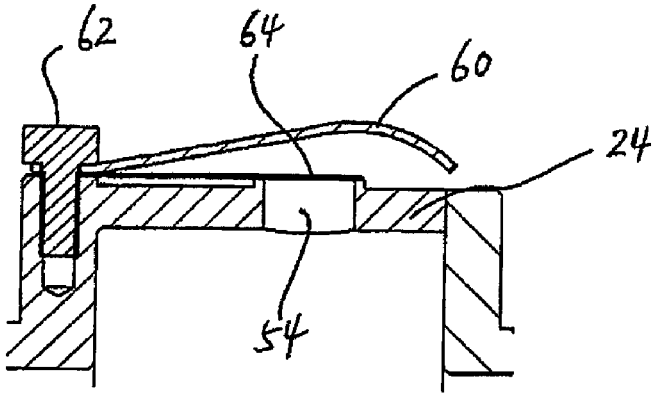
FIG. 6 is an enlarged, vertical cross-sectional view of the discharge valve of the exemplary embodiment of FIG. 5.

The compression cycle is shown in FIG. 4. In (a) there is shown the compressor 10 at the beginning of the suction phase to draw the working fluid into the suction chamber 66; and the compression of the working fluid in the compression chamber 68. The vane 12 separates the working chamber 36 into the suction chamber 66 and the compression chamber 68. When the compressor 10 has reached the position in (b), the suction of the fluid into the suction chamber 66 and compression in the compression chamber 68 is continuing. In (c) the suction process continues, and the discharge of the fluid through discharge ports 54 occurs when the pressure inside the compression chamber 68 exceeds that of the hollow interior 56 of the shell 40. At (d) the suction and discharge of the fluid have almost completed. As can be seen, the only movement of the vane 12 is a sliding movement relative to its slot 18 during the movement of the rotor 14 relative to cylinder 16. From an external, fixed frame the line contact 30 appears stationary. But from within the cylinder 16 the line contact 30 appears to move around the internal surface 22 of sidewall 24 once every complete revolution of the cylinder 16 and rotor 14.

Figure 7:
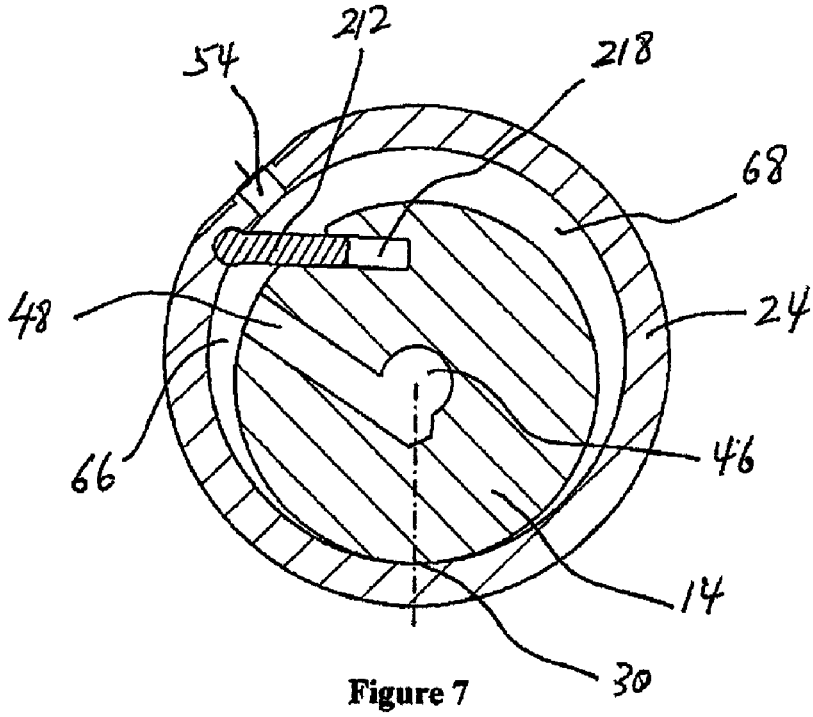
FIG. 7 is a vertical cross-sectional view corresponding to FIG. 2 of another exemplary embodiment.
Figure 8:
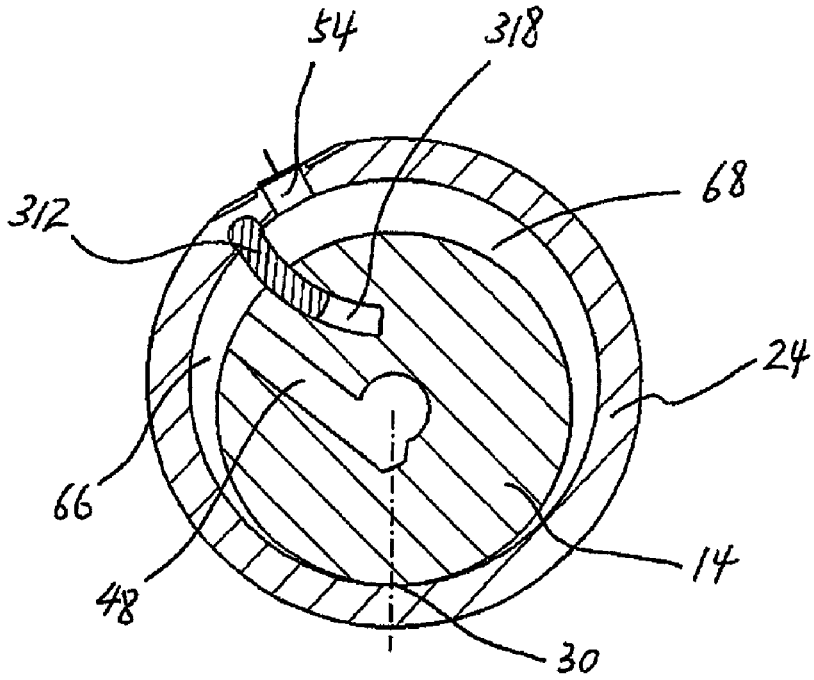
FIG. 8 is a vertical cross-sectional view corresponding to FIG. 2 of a further exemplary embodiment.

The vane 12 of FIGS. 1 to 6 is orientated radially to the rotational center of the rotor 14. However, a non-radial vane 212 in a non-radial slot 218 may be used as is shown in FIG. 7. The figure shows a vane that has an offset angle to give a trailing-type vane 212. However, the offset angle may be negative to give a leading-type vane 212. Similarly, and as shown in FIG. 8, a circularly-arced vane 312 may be used that slides in a circularly-arced slot 318.

Whilst there has been described in the foregoing description exemplary embodiments, it will be understood by those skilled in the technology concerned that many variations in details of design, construction and/or operation may be made without departing from the present invention.

The invention claimed is:

1. A revolving vane compressor comprising:

a cylinder comprising at least one discharge port in and through the cylinder; a rotor housed within the cylinder and being eccentrically mounted relative to the cylinder;

a vane mounted in a slot in the rotor for sliding movement relative to the rotor, the vane being securely connected to the cylinder to force the cylinder to rotate with the rotor; and a pressure shell surrounding the cylinder and the rotor, each discharge port being for discharging fluid into an enclosed volume of the pressure shell, wherein the cylinder is held within the enclosed volume.

2. A revolving vane compressor as claimed in claim 1, wherein the rotor is configured to be driven by a drive shaft, the rotor being configured to drive the cylinder by operative connection of the vane to the cylinder.

3. A revolving vane compressor as claimed in claim 1, wherein the rotor has a rotor longitudinal axis and the cylinder has a cylinder longitudinal axis parallel to and spaced from the rotor longitudinal axis.

4. A revolving vane compressor as claimed in claim 3, wherein the rotor further comprises a rotor shaft co-axial with rotor longitudinal axis, there being a suction inlet in the rotor shaft operatively connected to at least one suction port in a surface of the rotor.

5. A revolving vane compressor as claimed in claim 3, wherein the operative connection comprises a first portion of a suction inlet extending axially of the rotor shaft, and a second portion extending radially of the rotor.

6. A revolving vane compressor as claimed in claim 1, wherein the cylinder comprises a side wall and a pair of opposed end plates all of which are configured to rotate with the rotor.

7. A revolving vane compressor as claimed in claim 1, wherein each discharge port comprises a discharge valve; each discharge valve comprising a discharge valve reed over each discharge port, and a valve stop.

8. A revolving vane compressor as claimed in claim 1, wherein each discharge port is in and through the side wall of the cylinder.

9. A revolving vane compressor as claimed in claim 1, wherein the vane comprises an enlarged head that engages the cylinder in the manner of a hinge-type joint.

10. A revolving vane compressor as claimed in claim 1, wherein the slot extends relative to the rotor in a manner selected from the group consisting of: radially of the rotor, at an offset angle relative to the rotor, and circularly curved relative to the rotor.

11. A revolving vane compressor as claimed in claim 1, wherein a working chamber is formed between the cylinder and the rotor, the working chamber comprising a suction chamber and a compression chamber.

12. A revolving vane compressor as claimed in claim 11, wherein the vane separates the working chamber into the suction chamber and the compression chamber.

13. A revolving vane compressor as claimed in claim 1, wherein a line contact is formed between the rotor and an internal surface of the cylinder.

14. A revolving vane compressor comprising:

a cylinder at least partially housed within a pressure shell and establishing at least one discharge port;

a rotor at least partially housed within the cylinder and being eccentrically mounted relative to the cylinder; and a vane slideably receivable within a slot in the rotor, the vane secured relative to the cylinder to move the cylinder with the rotor, wherein the at least one discharge port is configured to communicate fluid to a discharge chamber bounded by the cylinder and a nonrotating housing, wherein the discharge chamber extends about the entire circumference of the cylinder.

15. The revolving vane compressor of claim 14, wherein the nonrotating housing is radially outside the cylinder.

16. A revolving vane compressor comprising:

a pressure shell;

a cylinder at least partially housed within the pressure shell and establishing at least one discharge port;

a rotor at least partially housed within the cylinder and being eccentrically mounted relative to the cylinder; and a vane slideably receivable within a slot in the rotor, the vane secured relative to the cylinder to move the cylinder with the rotor, wherein the pressure shell establishes an annular chamber that receives fluid communicated from the at least one discharge port.

17. The revolving vane compressor of claim 16, wherein the chamber is annularly distributed about the cylinder.

18. The revolving vane compressor of claim 16, wherein the cylinder is rotatable relative to the pressure shell.

19. A revolving vane compressor comprising:

a cylinder comprising at least one discharge port;

a rotor housed within the cylinder and being eccentrically mounted relative to the cylinder; and a vane slideably receivable within a slot in the rotor, the vane being secured relative to the cylinder to move the cylinder with the rotor about an axis, wherein the at least one discharge port is configured to communicate fluid radially from the cylinder to an annular chamber, the at least one discharge port rotatable relative to the annular chamber.

20. The revolving vane compressor of claim 16, wherein all portions of the pressure shell are radially spaced from the cylinder.

21. The revolving vane compressor of claim 19, wherein a shell housing the cylinder comprises the chamber.

22. The revolving vane compressor of claim 14, wherein the rotor further comprises a rotor shaft coaxial with a rotor longitudinal axis, there being a suction inlet in the rotor shaft operatively connected to at least one suction port in a surface of the rotor.

* * * * *